United States Patent [19]

Blase

[11] Patent Number: 4,843,750

[45] Date of Patent: Jul. 4, 1989

[54] FIREARM CLEANING DEVICE AND METHOD

[76] Inventor: Richard A. Blase, Rte. 2, Box 103, Asheboro, N.C. 27203

[21] Appl. No.: 204,855

[22] Filed: Jun. 10, 1988

[51] Int. Cl.[4] ..... F41C 31/00; F41C 31/02

[52] U.S. Cl. ..... 42/95; 102/442; 124/57

[58] Field of Search ..... 42/95, 1.14; 102/442, 102/440, 529; 222/3; 124/57, 74

[56] References Cited

U.S. PATENT DOCUMENTS

| | | | |
|---|---|---|---|
| 438,836 | 11/1909 | Fessenden | 102/442 |
| 1,495,008 | 5/1924 | Feagin | 42/95 |
| 2,375,314 | 5/1945 | Mills | 124/74 |
| 2,861,560 | 11/1958 | Alinari | 42/1.14 |
| 3,127,885 | 4/1964 | Kline et al. | 124/74 |
| 3,177,863 | 4/1965 | Spack | 124/74 |
| 3,494,344 | 12/1966 | Vadas et al. | 124/74 |
| 3,740,883 | 6/1973 | Kyle | 102/442 |
| 4,328,632 | 5/1982 | Beers | 42/95 |
| 4,783,925 | 11/1988 | Pollock, Jr. | 42/95 |

FOREIGN PATENT DOCUMENTS

| | | | |
|---|---|---|---|
| 2599827 | 12/1987 | France | 42/95 |

*Primary Examiner*—Deborah L. Kyle
*Assistant Examiner*—Michael J. Carone
*Attorney, Agent, or Firm*—Wigman & Cohen

[57] ABSTRACT

A disposable firearm cleaning device and method are disclosed for cleaning the chamber and bore of a firearm, especially in the field. The cleaning device comprises a rupturable compressed gas cartridge which is supported in the chamber of the firearm in spaced relation to the walls thereof. A puncturing pin actuable by the firing pin of the firearm is adapted to rupture a disc on the end of the cartridge to release the compressed gas which flows between the cartridge and chamber walls and out the bore of the firearm to clean the chamber and bore.

15 Claims, 2 Drawing Sheets

FIREARM CLEANING DEVICE AND METHOD

BACKGROUND OF THE INVENTION

The present invention relates to new and useful improvements to devices and methods for cleaning debris and dirt from firearms, such as rifles, shotguns, or the like, and more particularly to disposable firearm cleaning devices and methods which are convenient and specially adapted for use in the field.

Deposits of dirt, moisture, metal, burnt powder and similar foreign matter and debris on the interior side walls of the shell chamber and barrel or bore of a firearm is a common phenomenon. If uncorrected, such deposits not only cause the inside surfaces of the firearm to become scratched and corroded, but also can create a dangerous condition, particularly if the barrel becomes blocked by debris.

The bore of a firearm is conventionally cleaned by means of an elongated metal rod which includes cleaning implements, such as a brush or abrasive packs on one end. This technique is essential to proper maintenance of a firearm, but has been found to be bulky, tedious and inconvenient to use in the field.

Various attempts to obviate the aforementioned convenience problem have been described in the prior art. For example, U.S. Pat. No. 4,328,632 discloses a gun cleaning device which is of similar size and appearance to a standard shell and thus convenient to carry and use in the field. A compressed gas cartridge, upon discharge, is propelled through the gun barrel pushing a cleaning wad through the same. One disadvantage of this prior art device is the fact that the shell chamber, where the device is seated prior to activation, is not cleaned in the process. A further disadvantage of this device is that, upon activation, the compressed gas cartridge is rapidly discharged from the barrel opening in a manner similar to a projectile with the potential for causing injury and/or property damage.

In U.S. Pat. No. 938,836, there is similarly disclosed a gun cleaning device comprising a shell-like compressed gas cylinder which is punctured and drives out a "cleaning bullet" for cleaning the bore as it passes therethrough. However, this device also fails to clean the shell chamber portion of the firearm.

SUMMARY AND OBJECTS OF THE INVENTION

In view of the foregoing limitations and shortcomings of the prior art devices, it should be apparent that there still exists a need in the art for a convenient, field usable and disposable cleaning device capable of simultaneously flushing both the shell chamber and the firearm bore or barrel with compressed gas and which will not project a solid, bullet-like projectile capable of causing serious human injury or property damage.

It is, therefore, a primary object of this invention to fulfill that need by providing a disposable firearm cleaning device having configurations similar to those of standard shells and, hence, is convenient to use and carry and which effectively and safely cleans both the shell chamber and the barrel or bore walls of a firearm.

More particularly, it is an object of this invention to provide a firearm shell chamber and bore cleaner, especially for use in the field, comprising a cartridge containing a compressed gas, such as $CO_2$ or the like, which upon discharge will effectively flush deposits of dirt, moisture, metal, burnt powder and the like and which may, at the option of the user, propel an attachable lightweight lubricated cleaning wad through the firearm barrel to further loosen and remove such deposits and to apply a lubricant to the inside wall of the barrel.

It is another object of this invention to provide a firearm cleaner of the aforesaid type wherein the cartridge is centrally positioned within the chamber by a plurality of fins or struts which are secured to a mounting structure.

Yet another object of the invention is to provide a device of the aforesaid type wherein a self-contained, spring-biased pin in the device which is capable of quickly penetrating and rupturing the gas cartridge closure cap and activating the device.

A further object of the invention is to provide a safe, convenient and economical method of cleaning a firearm in the field using the device of the aforesaid type.

These and other objects and advantages of the present invention will become apparent by reference to the more detailed description which follows, as well as to the appended claims and the several views illustrated in the drawings.

DETAILED DESCRIPTION OF A PREFERRED EMBODIMENT

Figure 1:
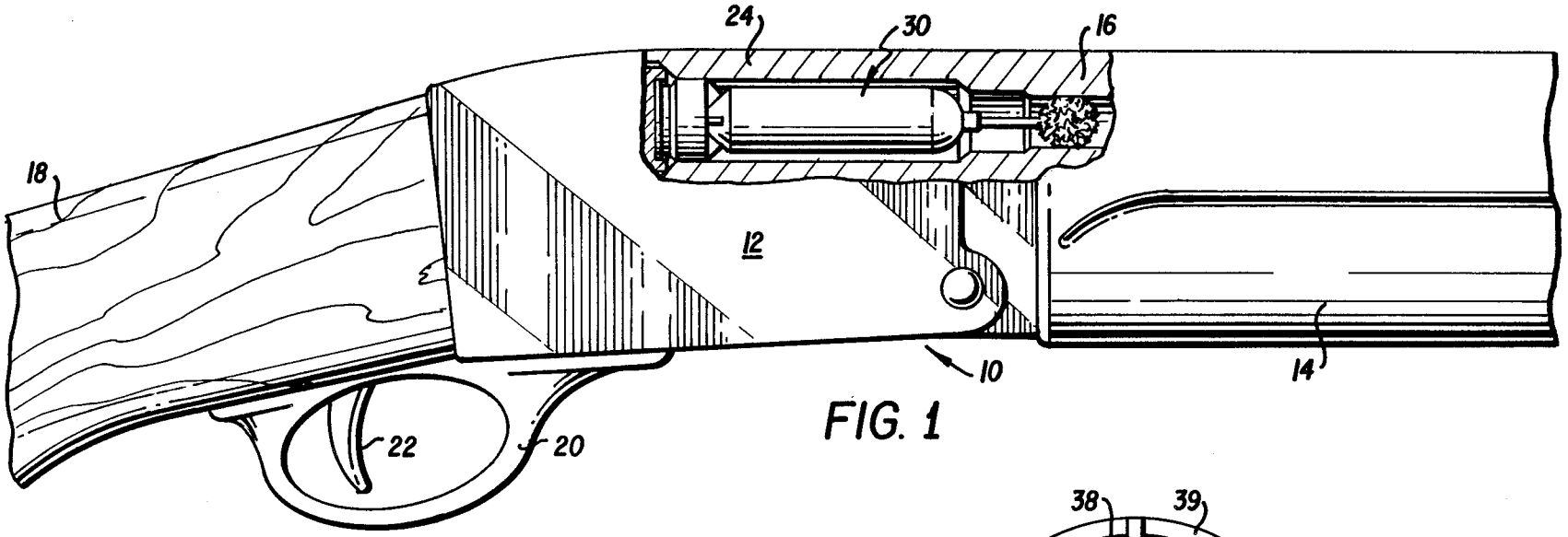
FIG. 1 is a fragmentary cross-sectional view of a firearm showing the firearm cleaning device of the present invention situated therein.
Figure 5:
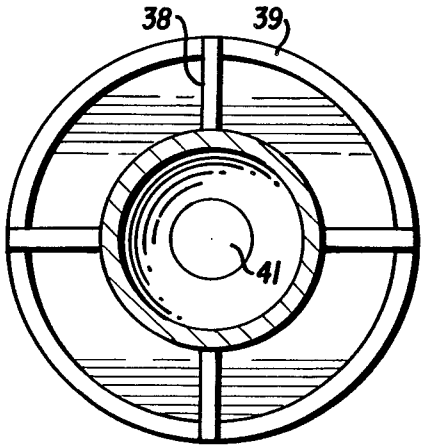
FIG. 5 is a cross-section view taken along line 5—5 of FIG. 3.
Figure 2:
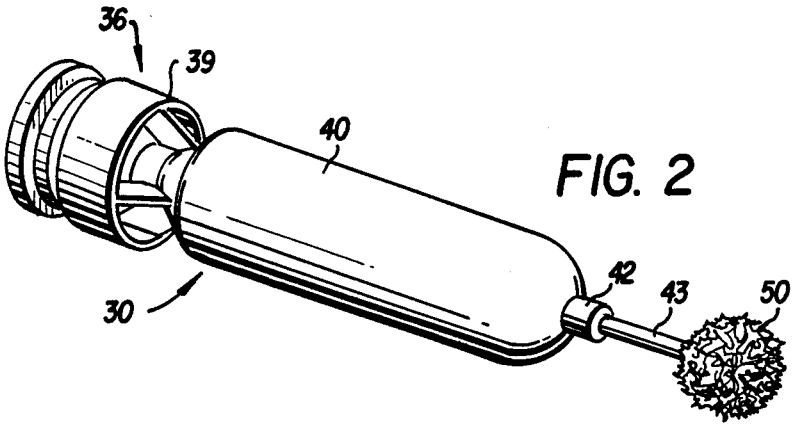
FIG. 2 is a perspective view of the firearm cleaning device of the invention.
Figure 4:
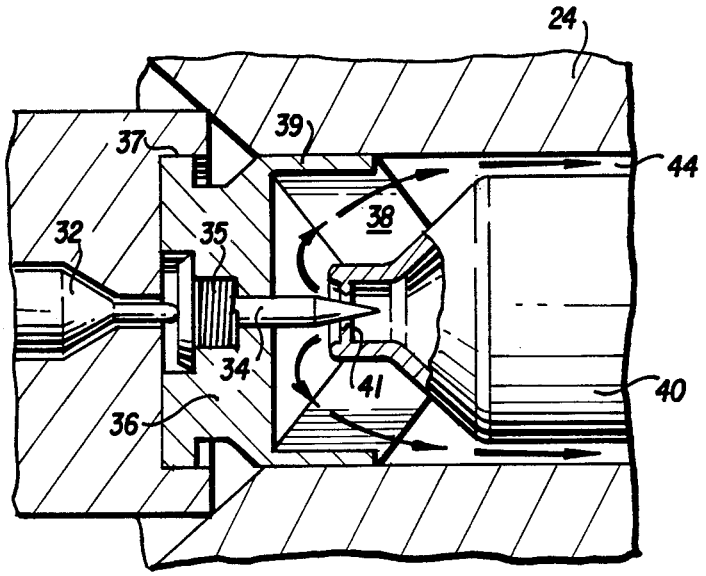
FIG. 4 is an enlarged view of the firing mechanism showing the puncturing of the gas cartridge.

Referring more specifically to the drawings wherein like numerals indicate like elements throughout the several views, there is illustrated in FIG. 1 a preferred embodiment of the cleaning device of the present invention used in connection with a firearm designated generally by reference numeral 10. In particular, the firearm 10, a shotgun for example, includes a receiver 12, foreend 14, barrel 16 and stock 18. Also included in such conventional firearm is a trigger guard 20, and trigger 22 conventionally connected by a mechanism (not shown) to a firing pin 32 (FIG. 4) which is driven forwardly in the receiver 12 through an opening the rearward end of chamber 24.

Figure 3:
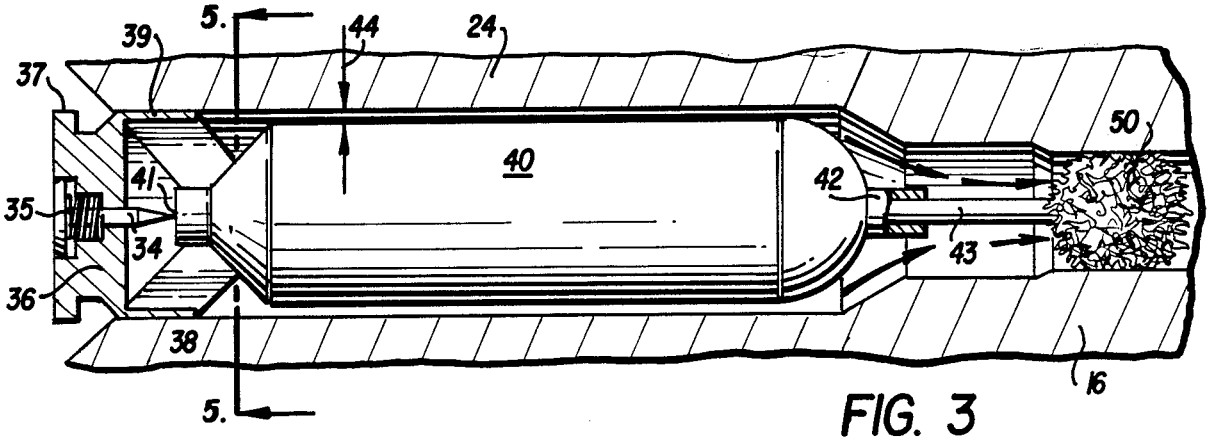
FIG. 3 is a side view partly in section of the cleaning device of the present invention in a pre-actuation position.

The firearm cleaning device 30 of the present invention may be used for a variety of different types of firearms, including shotguns, rifles, pistols and revolvers. As best seen in FIG. 3, the present forearm cleaning device 30, comprises a compressed gas cartridge 40 which is sealed on its rearward end by a rupturable disc 41. Sleeve means 42 is centrally mounted (as by welding) on the forward end of the cartridge 40 adjacent the rearward or chamber end of barrel 16. Sleeve means 42 receives a barrel swab comprising a stem 43 on which is mounted a cleaning wad 50. At the rearward end of the cartridge 40 positioned adjacent to the firing pin 32 (FIG. 4) is a structure 36 supporting a spring-biased pin 34 adapted to puncture the disc 41 in response to activation by forward movement of the firing pin 32. The cartridge 40 is centrally positioned within the chamber in spaced relation to the chamber sidewalls by a plurality of fins or struts 38 which are secured to a ring 39 and flange 37 which forms a part of the structure 36. The diameter of cartridge 40 is preferably greater than the diameter of the barrel 16, but less than the diameter of the chamber 24 resulting in annular space 44 through which the discharging gas can escape upon rupture of disc 41.

In the use and operation of the present firearm cleaning device, which is similar in size and shape to an unfired shell, the device 30 is inserted in the chamber with a freshly lubricated barrel swab. The chamber is then closed so that the device 30 is situated in the position illustrated in FIG. 1. The firearm is pointed in a safe direction, and the firing pin is actuated by a hammer in receiver 12 when trigger 22 is pulled. The firing pin 32 strikes the spring-biased pin 34 which, in turn, strikes and ruptures disc 41 and is retracted from the disc by the spring 35 thereby releasing the $CO_2$ or other suitable gas, such as nitrogen, air, etc. from the cylinder 40. The escaping gas is deflected by structure 36 and rapidly flows forwardly to the annular space 44 formed between the compressed gas cylinder 40 and the chamber walls (as shown by the arrows in FIG. 4) thereby removing debris from the chamber walls. The escaping gas continues to flow forwardly to the barrel 16 (as shown by the arrows in FIG. 3) removing debris and propels the barrel swab and its cleaning wad 50 through the barrel 16. As wad 50 travels through the barrel, it wipes the inner surface of the barrel 16 to loosen any residual dirt, burnt powder, moisture or other debris which is then carried through the bore 16 and out the free end of the barrel.

Alternatively, at the discretion of the user, the device may be used without the barrel swab and its cleaning wad 50 if, for example, the bore is blocked or if the quantity of dirt and debris in the bore 16 is such that it may impede safe or effective passage of wad 50 through the bore 16. A lubricant may also be incorporated in the compressed gas in a conventional manner, especially for use without a barrel swab.

As the $CO_2$ is discharged, the device 30 including the cartridge 40 is retained in place in the chamber 24 in the same manner as a live shell would be retained, that is, by a conventional mechanism (not shown) which grips the flange 37. Even if the device were not gripped in such a fashion, the relative diameters of the cartridge 40 and barrel 16 would prevent the cartridge from being projected through the barrel. Following activation, the spent cartridge and discharged barrel swab and cleaning wad 50, all composed of inexpensive materials, may be disposed of in a conventional manner.

From the foregoing description, it will be apparent that the present invention provides an extremely simple and economical device for cleaning both the chamber and barrel walls of a firearm while in the field. The present invention also is safer to use than the known prior art cleaning devices described above because cleaning is accomplished without projecting a hard or otherwise dangerous object which can injure the user or persons standing nearby or damage property.

It will be appreciated that many modifications and variations of the present invention are possible in light of the above teachings and within the purview of the appended claims without departing from the spirit and intended scope of the invention.

What I claim is:

1. A device for cleaning the bore of a firearm having a firing pin and a shell chamber, said device comprising a compressed gas cartridge of a size sufficient to be received in said chamber of said firearm, means for positioning said cartridge in said shell chamber adjacent to the firing pin of said firearm, said positioning means supporting a spring-biased pin means for puncturing the gas cartridge to release the compressed gas from the cartridge whereby the discharged gases from said cartridge flush both the shell chamber and bore of said firearm.

2. The device according to claim 1, wherein said compressed gas cartridge is a cylinder having a smaller diameter than the diameter of said chamber forming an annular space of a magnitude sufficient to accommodate passage of said gas upon discharge.

3. The device according to claim 1 wherein said positioning means further includes strut means secured to said cartridge for supporting said cartridge in operative relation to said puncturing pin means.

4. A device for cleaning the bore of a firearm having a shell chamber, said device comprising a compressed gas cartridge of a size sufficient to be received in said chamber of said firearm, a cleaning wad mounted on the forward end of said cartridge whereby the discharged gases from said cartridge flush both the shell chamber and bore of said firearm.

5. The device according to claim 4 wherein said cleaning wad is carried by a stem releasably secured within a sleeve mounted on said forward end of said cylinder.

6. A method of cleaning a firearm having a trigger mechanism, a shell chamber with walls and a barrel with walls comprising the steps of:

providing a compressed gas cylinder;

discharging the gas from said cylinder upon activation of the trigger mechanism of said firearm;

projecting by means of the flow of said discharged gas, a wad capable of removing or loosening debris from the walls of the barrel of said firearm; and removing unwanted debris from the walls of the shell chamber and barrel of said firearm by means of the flow of the said discharged gas.

7. The method of claim 6 including the steps of providing a lubricant in the compressed gas cylinder; and applying said lubricant to the inside wall of the barrel when the gas is discharged.

8. A cleaning device for a firearm having a firing pin, a shell chamber having sidewalls and a barrel with a bore, said device comprising a compressed gas cartridge adapted to be inserted in the shell chamber such that said cartridge is spaced from the sidewalls of the chamber, means for supporting said cartridge in spaced relation to the sidewalls of the chamber, said supporting means comprising strut means secured to said cartridge, means for releasing the compressed gas from said cartridge to flush said chamber, the sidewalls thereof and the bore, said gas releasing means comprising a spring-biased pin means for puncturing said gas cartridge to release the compressed gas.

9. The cleaning device of claim 8, wherein said supporting means further comprises ring means, said puncturing means being disposed in and carried by said ring means, said cartridge having a rupturable portion confronting said puncturing means.

10. The cleaning device of claim 9, wherein the firing pin, puncturing means and rupturable portion of said cartridge are aligned along the axis of the chamber and bore of the firearm.

11. The cleaning device of claim 8, including swab means releasably mounted to said cartridge at the end thereof adjacent the bore for cleaning the bore.

12. The cleaning device of claim 11, wherein said swab means comprises a stem and a wad mounted on said stem.

13. The cleaning device of claim 11, including a tubular sleeve fixed coaxially to the end of said cartridge, said swab means being releasably disposed in said tubular sleeve.

14. The cleaning device of claim 8, wherein said supporting means comprises a ring means having a flange adapted to be secured in said chamber and a plurality of struts affixed to said ring means and said cartridge whereby the released gas passes from said cartridge through the struts, between the cartridge and chamber of the firearm and out the bore of the firearm.

15. A device for cleaning the bore of a firearm having a shell chamber, said device comprising a compressed gas cartridge of a size sufficient to be received in said chamber of said firearm, said cartridge containing a lubricant whereby the discharged gases and lubricant from said cartridge flush and lubricate both the shell chamber and the bore of said firearm.

* * * * *